US010017966B2

(12) United States Patent
Lin et al.

(10) Patent No.: US 10,017,966 B2
(45) Date of Patent: Jul. 10, 2018

(54) ELECTRONIC LOCK

(71) Applicant: FLYTECH TECHNOLOGY CO., LTD, Taipei (TW)

(72) Inventors: Chiung-Chi Lin, Taipei (TW); Ping-Chou Chen, Taipei (TW); Chih-Kuang Chiang, Taipei (TW); Chin-Lung Yang, Taipei (TW); Li-Wen Yeh, Taipei (TW); Sung-Lin Chan, Taipei (TW)

(73) Assignee: FLYTECH TECHNOLOGY CO., LTD, Taipei (TW)

( * ) Notice: Subject to any disclaimer, the term of this patent is extended or adjusted under 35 U.S.C. 154(b) by 525 days.

(21) Appl. No.: 14/823,483

(22) Filed: Aug. 11, 2015

(65) Prior Publication Data

US 2016/0348404 A1 Dec. 1, 2016

(30) Foreign Application Priority Data

Jun. 1, 2015 (TW) ..... 104208658 U

(51) Int. Cl.
*E05C 19/16* (2006.01)
*E05B 73/00* (2006.01)
(Continued)

(52) U.S. Cl.
CPC ..... *E05B 73/0082* (2013.01); *E05B 47/0002* (2013.01); *E05B 47/0676* (2013.01); *E05C 9/045* (2013.01)

(58) Field of Classification Search
CPC .... Y10T 292/11; Y10T 24/32; Y10T 70/7057; Y10T 16/5401; E05C 19/166;
(Continued)

(56) References Cited

U.S. PATENT DOCUMENTS 5,184,856 A * 2/1993 Waltz ..... E05C 19/168 292/144
6,260,892 B1 * 7/2001 Chang ..... E05C 19/166 292/251.5

(Continued)

*Primary Examiner* — Mark A Williams
(74) *Attorney, Agent, or Firm* — WPAT, PC

(57) ABSTRACT

An electronic lock includes a base, an electromagnetic mechanism, a connecting mechanism, a clamping mechanism and a magnetically-attractable plate. The base has an opening. The electromagnetic mechanism has a protrusion block. The electromagnetic mechanism is installed within the base. The protrusion block is penetrated through the opening and exposed outside the base. The connecting mechanism is connected with a rear cover. The clamping mechanism is arranged between the connecting mechanism and the electromagnetic mechanism. Moreover, the magnetically-attractable plate is connected with the clamping mechanism. When the electromagnetic mechanism is electrically conducted to generate a magnetic attraction force, the magnetically-attractable plate is attracted by the magnetic attraction force, so that the clamping mechanism is attracted on the electromagnetic mechanism. By pushing the protrusion block of the electromagnetic mechanism, the clamping mechanism is correspondingly moved and disengaged from the connecting mechanism.

7 Claims, 5 Drawing Sheets

(51) Int. Cl.
*E05B 47/00* (2006.01)
*E05B 47/06* (2006.01)
*E05C 9/04* (2006.01)

(58) Field of Classification Search
CPC ..... E05C 17/56; E05C 19/16; E05C 19/163; E05C 19/168; G06F 1/1679; E05B 15/0073; E05B 47/0038
USPC ..... 292/251.5
See application file for complete search history.

(56) References Cited

U.S. PATENT DOCUMENTS

| | | | | |
|---|---|---|---|---|
| 2004/0026933 | A1* | 2/2004 | Smith | E05C 19/166 292/251.5 |
| 2004/0041414 | A1* | 3/2004 | Mandall | E05C 19/166 292/251.5 |
| 2004/0189017 | A1* | 9/2004 | Chen | E05B 63/248 292/251.5 |
| 2007/0194578 | A1* | 8/2007 | Boosey | E05B 15/101 292/251.5 |
| 2007/0262592 | A1* | 11/2007 | Hwang | E05C 19/166 292/251.5 |
| 2009/0235702 | A1* | 9/2009 | Huang | E05C 19/168 70/276 |
| 2010/0270817 | A1* | 10/2010 | Yu | G06F 1/1616 292/251.5 |
| 2015/0308170 | A1* | 10/2015 | Chang | E05C 19/166 292/251.5 |

* cited by examiner

ELECTRONIC LOCK

FIELD OF THE INVENTION

The present invention relates to a lock, and more particularly to an electronic lock.

BACKGROUND OF THE INVENTION

Generally, when manufacturers of electronic devices exhibit the electronic devices on a display platform publicly, the electronic devices are usually locked by locks. The uses of the locks can prevent the electronic devices from being stolen. For example, a mechanical lock is one of the widely-used locks. Generally, the mechanic anti-theft lock comprises a lock latch and lock groove. In a locking state, the lock tongue and the lock notch are engaged with each other. In addition, a corresponding key is used to unlock the mechanic anti-theft lock through rotation. Conventionally, different mechanic anti-theft locks are unlocked by different keys. As the number of keys increases, the possibility of losing he keys increases. In other words, the approach of unlocking the mechanic anti-theft lock is not user-friendly. Moreover, the structures of the conventional mechanic anti-theft locks are very simple. Consequently, the mechanic anti-theft locks can be easily unlocked by an auxiliary tool.

Therefore, there is a need of providing an improved structure of a lock in order to solve the drawbacks of the conventional anti-theft lock.

SUMMARY OF THE INVENTION

An object of the present invention provides an electronic lock with a locking function and with operating convenience.

In accordance with an aspect of the present invention, there is provided an electronic lock. The electronic lock includes a base, an electromagnetic mechanism, a connecting mechanism, a clamping mechanism and a magnetically-attractable plate. The base includes an opening. The electromagnetic mechanism is disposed within the base. When an electric current flows through the electromagnetic mechanism, the electromagnetic mechanism generates a magnetic attraction force. The electromagnetic mechanism has a protrusion block. The protrusion block is penetrated through the opening of the base and exposed outside the base. The connecting mechanism includes an engaging part with two connecting holes. The clamping mechanism is arranged between the connecting mechanism and the electromagnetic mechanism. The clamping mechanism includes two stopping blocks. The two stopping blocks are respectively inserted into the two connecting holes of the engaging part. The magnetically-attractable plate is connected with the clamping mechanism. When no electric current flows through the electromagnetic mechanism, the magnetically-attractable plate is detached from the electromagnetic mechanism. When the electric current flows through the electromagnetic mechanism and the electromagnetic mechanism generates the magnetic attraction force, the magnetically-attractable plate is attracted by the magnetic attraction force, so that the clamping mechanism is attracted on the electromagnetic mechanism. When the protrusion block of the electromagnetic mechanism is pushed and the clamping mechanism is correspondingly moved, the two stopping blocks are disengaged from the corresponding connecting holes.

In an embodiment, the engaging part of the connecting mechanism further includes a recess. The clamping mechanism and the magnetically-attractable plate are accommodated within the recess.

In an embodiment, the two stopping blocks have corresponding slant surfaces that assist in disengaging the two stopping blocks from the corresponding connecting holes.

In an embodiment, the clamping mechanism further includes two elastic elements, and the two elastic elements are in contact with the corresponding stopping blocks. While the clamping mechanism is moved, the two elastic elements are compressed by the corresponding stopping blocks, so that the two stopping blocks are disengaged from the corresponding connecting holes.

In an embodiment, the electromagnetic mechanism comprises a pushing plate and an electromagnet. The electromagnet is fixed on the pushing plate, and the protrusion block is located at a side of the pushing plate.

In an embodiment, the magnetically-attractable plate is fixed on the clamping mechanism.

In an embodiment, the electronic lock further includes a rear cover. An electronic device is fixed on the rear cover. The rear cover has an accommodation space. The engaging part is accommodated within the accommodation space. The accommodation space has two mounting holes corresponding to the two stopping blocks. After the engaging part is accommodated within the accommodation space and the two stopping blocks are inserted into the corresponding mounting holes, the engaging part is fixed on the rear cover.

The above objects and advantages of the present invention will become more readily apparent to those ordinarily skilled in the art after reviewing the following detailed description and accompanying drawings, in which:

DETAILED DESCRIPTION OF THE PREFERRED EMBODIMENT

Figure 1:
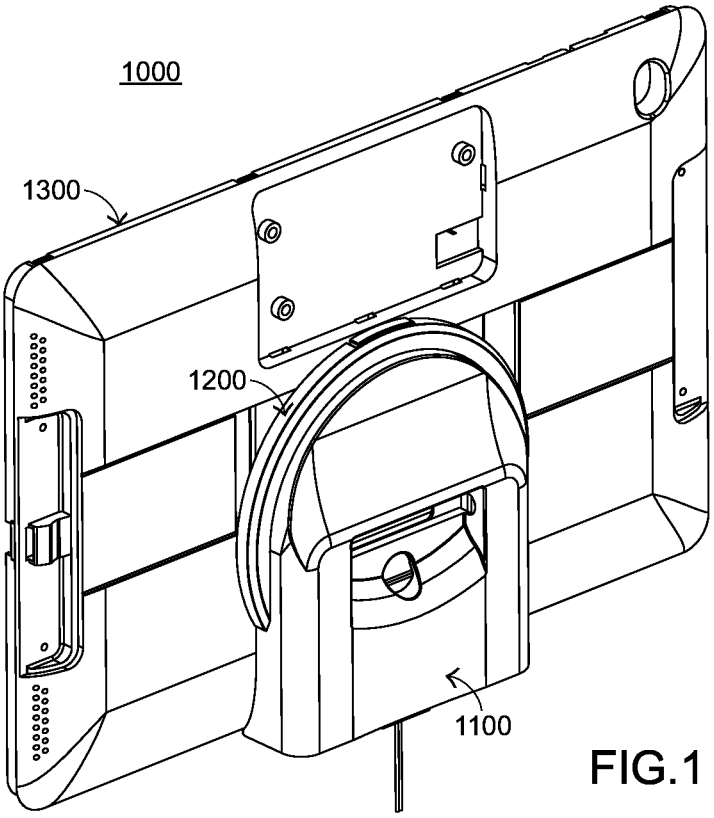
FIG. 1 is a schematic perspective view illustrating an electronic lock according to an embodiment of the present invention.

FIG. 1 is a schematic perspective view illustrating an electronic lock according to an embodiment of the present invention. As shown in FIG. 1, the electronic lock 1000 comprises a base 1100, a connecting mechanism 1200 and a rear cover 1300. The base 1100 is fixed on a surface of a display platform (not shown). The rear cover 1300 is used for fixing an electronic device such as a tablet computer. The rear cover 1300 and the connecting mechanism 1200 are engaged with each other. When the electronic lock 1000 is in a locked state, the rear cover 1300 is locked on the base 1100 through the connecting mechanism 1200. When the electronic lock 1000 is in an unlocked state, the rear cover 1300 can be detached from the connecting mechanism 1200.

Figure 2:
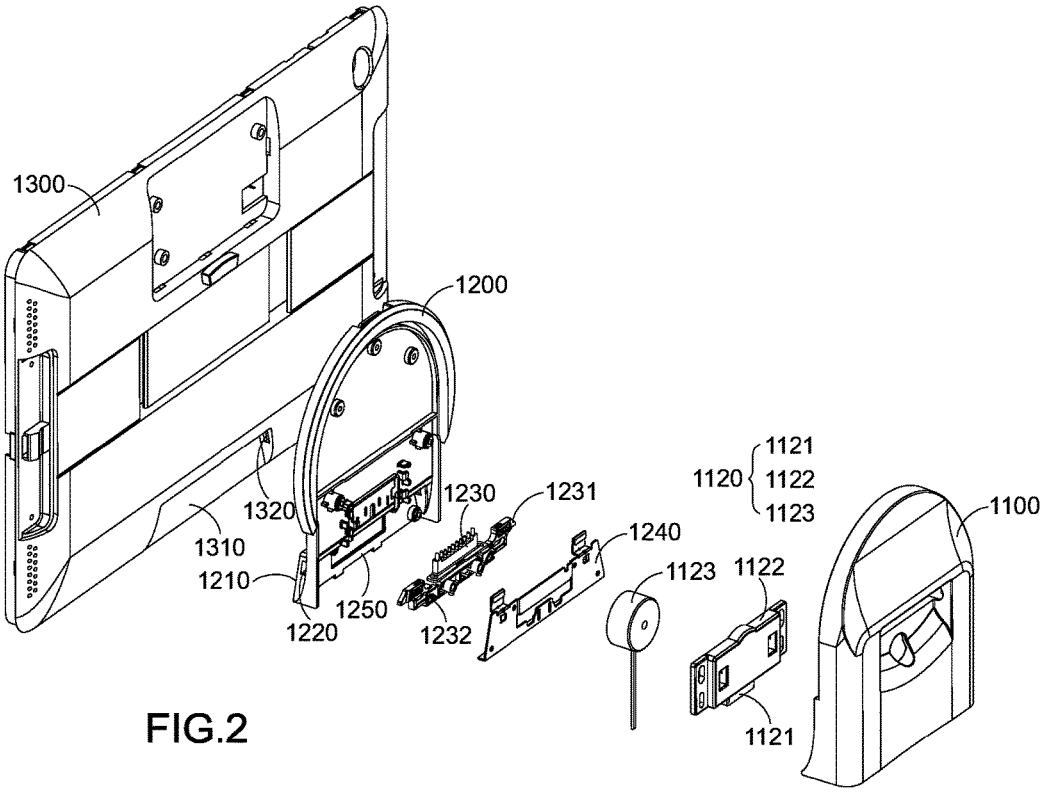
FIG. 2 is a schematic exploded view illustrating the electronic lock according to the embodiment of the present invention.
Figure 3:
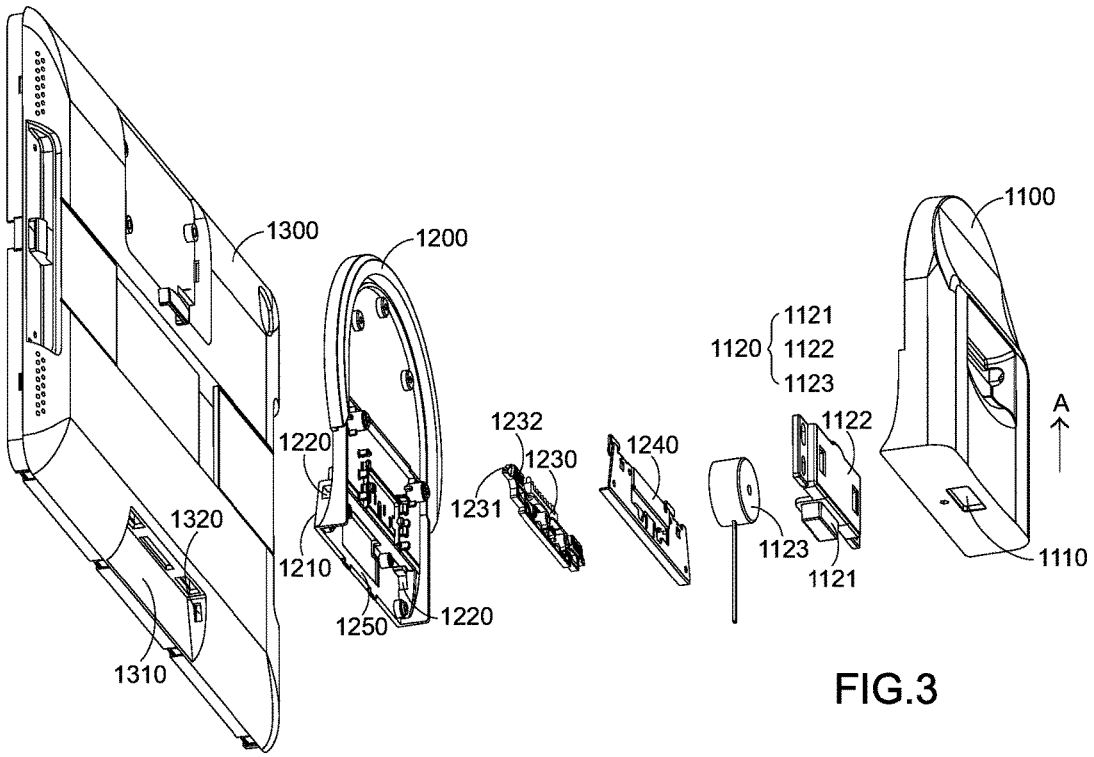
FIG. 3 is a schematic exploded view illustrating the electronic lock of FIG. 2 and taken along another viewpoint.

The structure of the electronic lock will be illustrated in more details as follows. FIG. 2 is a schematic exploded view illustrating the electronic lock according to the embodiment of the present invention. FIG. 3 is a schematic exploded view illustrating the electronic lock of FIG. 2 and taken along another viewpoint. As mentioned above, the electronic lock 1000 comprises the base 1100, the connecting mechanism 1200 and the rear cover 1300. Moreover, the electronic lock 1000 further comprises an electromagnetic mechanism 1120, a clamping mechanism 1230 and a magnetically-attractable plate 1240. The base 1100 has an opening 1110. The electromagnetic mechanism 1120 has a protrusion block 1121. The electromagnetic mechanism 1120 is disposed within the base 1100. The protrusion block 1121 is penetrated through the opening 1110 of the base 1100 and exposed outside the base 1100. By pushing the protrusion block 1121 exposed outside the base 1100, the electromagnetic mechanism 1120 is movable. The connecting mechanism 1200 comprises an engaging part 1210 and two connecting holes 1220. The two connecting holes 1220 are formed in the engaging part 1210. After the clamping mechanism 1230 and the magnetically-attractable plate 1240 are combined together, the combination of the clamping mechanism 1230 and the magnetically-attractable plate 1240 is arranged between the connecting mechanism 1200 and the electromagnetic mechanism 1120. The engaging part 1210 of the connecting mechanism 1200 comprises a recess 1250. The clamping mechanism 1230 is accommodated within the recess 1250. The clamping mechanism 1230 comprises two stopping blocks 1231. When the clamping mechanism 1230 is accommodated within the recess 1250, the two stopping blocks 1231 are inserted into the corresponding connecting holes 1220. Consequently, the clamping mechanism 1230 is connected with the connecting mechanism 1200. The rear cover 1300 has an accommodation space 1310 for accommodating the engaging part 1210 of the connecting mechanism 1200. Moreover, the accommodation space 1310 has two mounting holes 1320 corresponding to the two stopping blocks 1231. After the engaging part 1210 of the connecting mechanism 1200 is accommodated within the accommodation space 1310 and the two stopping blocks 1231 are inserted into the corresponding mounting holes 1320, the engaging part 1210 is fixed on the rear cover 1300.

The process of unlocking the electronic lock of the present invention will be illustrated as follows. As mentioned above, the rear cover 1300 for fixing the electronic device is locked on the connecting mechanism 1200 through the clamping mechanism 1230. In case that no electric current flows through the electromagnetic mechanism 1120, the clamping mechanism 1230 that is connected with the magnetically-attractable plate 1240 is separated from the electromagnetic mechanism 1120. Meanwhile, there is a gap between the clamping mechanism 1230 and the electromagnetic mechanism 1120. That is, if the electronic lock is not electrically conducted, the user cannot detach the clamping mechanism 1230 from the connecting holes 1220 through the outside of the electronic lock. Whereas, in case that electric current flows through the electromagnetic mechanism 1120, the electromagnetic mechanism 1120 generates a magnetic attraction force. Due to the magnetic attraction force, the magnetically-attractable plate 1240 is magnetically attracted by the electromagnetic mechanism 1120, and the clamping mechanism is also magnetically attracted by the electromagnetic mechanism 1120. Meanwhile, by pushing the protrusion block 1121 of the electromagnetic mechanism 1120 toward the inside of the base 1100 (i.e., in the direction indicated by the arrow A), the clamping mechanism 1230 is correspondingly moved in the direction A. Consequently, the two stopping blocks 1231 of the clamping mechanism 1230 are disengaged from the corresponding connecting holes 1220 of the engaging part 1210 and the corresponding mounting holes 1320 of the rear cover 1300. Meanwhile, the connecting mechanism 1200 and the rear cover 1300 are no longer clamped by the clamping mechanism 1230. After the rear cover 1300 is removed from the connecting mechanism 1200, the unlocking process is completed.

Figure 4:
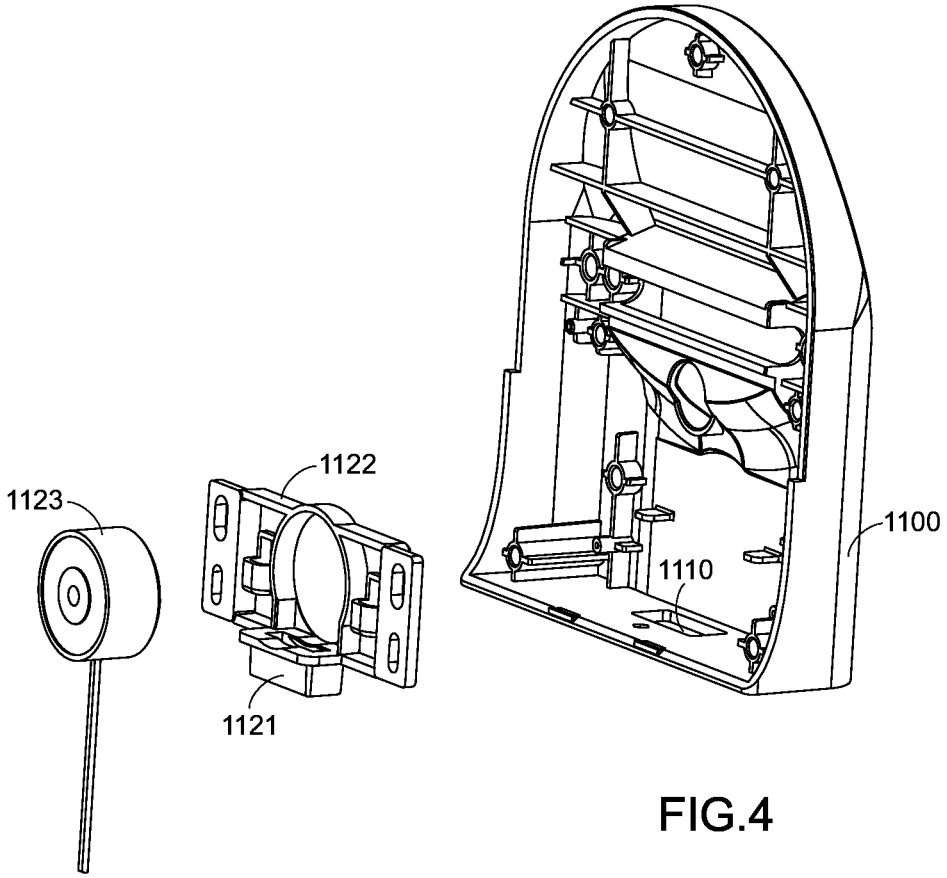
FIG. 4 is a schematic exploded view illustrating the relationship between the base and the electromagnetic mechanism of the electronic lock according to the embodiment of the present invention.

Please refer to FIG. 4. FIG. 4 is a schematic exploded view illustrating the relationship between the base 1100 and the electromagnetic mechanism 1120 of the electronic lock according to the embodiment of the present invention. As shown in FIGS. 2 and 4, the electromagnetic mechanism 1120 comprises a pushing plate 1122 and an electromagnet 1123. The electromagnet 1123 is fixed on the pushing plate 1122 and electrically connected with a power source (not shown). Moreover, the protrusion block 1121 is located at a side of the pushing plate 1122. Moreover, another side of the pushing plate 1122 has a receiving space matching the electromagnet 1123. Through the receiving space, the electromagnet 1123 can be fixed on the pushing plate 1122. Moreover, the protrusion block 1121 is penetrated through the opening 1110 of the base 1100 and connected with the base 1100.

Figure 5:
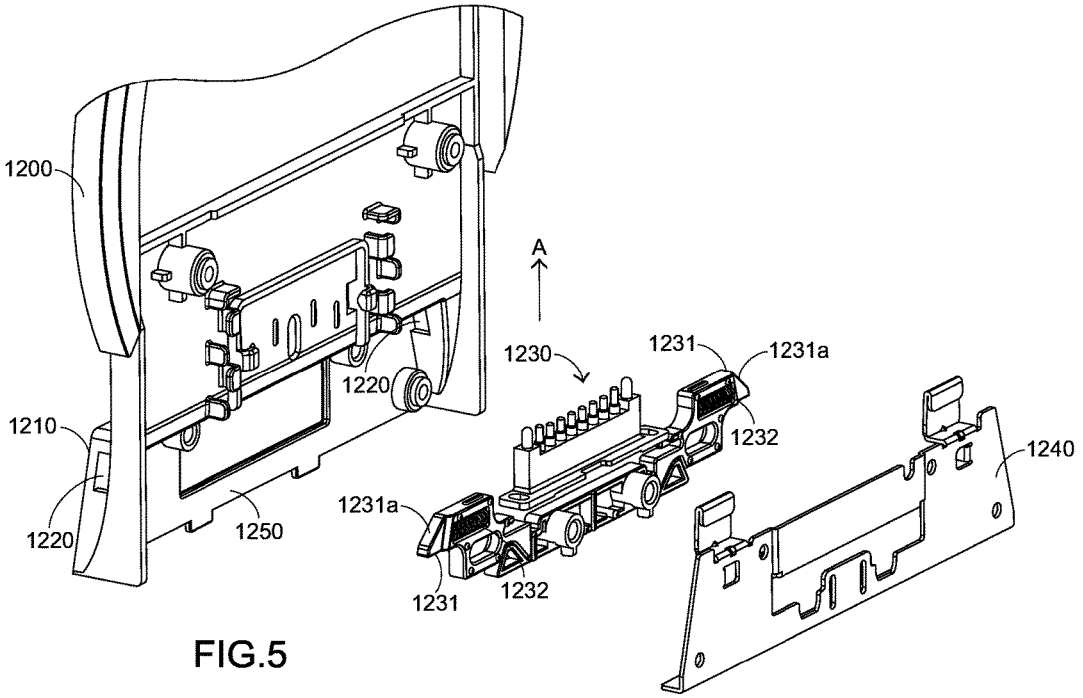
FIG. 5 is a schematic exploded view illustrating the relationship between the connecting mechanism, the clamping mechanism and the magnetically-attractable plate of the electronic lock according to the embodiment of the present invention.

Hereinafter, the engagement and detachment of the electronic components of the electronic lock of the present invention will be illustrated with reference to FIG. 5. FIG. 5 is a schematic exploded view illustrating the relationship between the connecting mechanism 1200, the clamping mechanism 1230 and the magnetically-attractable plate 1240 of the electronic lock according to the embodiment of the present invention. As shown in FIG. 5, each of the two stopping blocks 1231 of the clamping mechanism 1230 has a slant surface 1231*a*. Moreover, the clamping mechanism 1230 further comprises two elastic elements 1232. The two elastic elements 1232 are in contact with the corresponding stopping blocks 1231 for assisting in disengaging the two stopping blocks 1231 from the corresponding connecting holes 1220. In particular, while the clamping mechanism 1230 is moved in the direction A, the two stopping blocks 1231 are moved in the directions along the corresponding slant surfaces 1231*a* so as to compress the two elastic elements 1232. Consequently, the two stopping blocks 1231 of the clamping mechanism 1230 are disengaged from the corresponding connecting holes 1220 of the engaging part 1210 and the corresponding mounting holes 1320 of the rear cover 1300. Meanwhile, the unlocking process is completed.

From the above descriptions, the present invention provides an electronic lock with a locking function and with operating convenience. Consequently, the problem of using different keys to unlock different conventional anti-theft locks will be overcome. Moreover, a power source temporarily provides electric current to the electromagnetic mechanism, so that a magnetic attraction force is generated. Since the magnetically-attractable plate is magnetically attracted by the magnetic attraction force, the purpose of unlocking and disassembling the electronic lock can be achieved indirectly. In particular, when no electric current flows through the electronic lock, the two stopping blocks in the connecting mechanism are penetrated through the corresponding connecting holes of the engaging part and the corresponding mounting holes of accommodation space of the rear cover. Then, electronic device is locked on the display platform through the base. Consequently, the user cannot detach the clamping mechanism from the connecting holes through the outside of the electronic lock, and the user cannot unlock the electronic lock through the outside of the electronic lock. For unlocking the electronic lock, it is necessary to electrically conduct the electromagnetic mechanism so as to indirectly move the clamping mechanism that is disposed within the connecting mechanism. Consequently, the two stopping blocks are disengaged from the corresponding connecting holes and the corresponding mounting holes. After the rear cover is detached from the base, the unlocking purpose is achieved and the anti-theft efficacy is enhanced. Moreover, the electronic lock is electrically conducted only when the electronic lock is unlocked. That is, in the locked state, the anti-theft purpose can be achieved without the need of additionally providing electric current to the electronic lock. A power source provides electric current to the electronic lock only when the electronic lock needs to be unlocked. After the electronic lock is electrically conducted, the user has to push the protrusion block within a specified time period so as to unlock the electronic lock. Consequently, the possibility of falling down and damaging the electronic device will be minimized. In conclusion, the electronic lock of the present invention is simple, power-saving and burglarproof.

While the invention has been described in terms of what is presently considered to be the most practical and preferred embodiments, it is to be understood that the invention needs not be limited to the disclosed embodiments. On the contrary, it is intended to cover various modifications and similar arrangements included within the spirit and scope of the appended claims which are to be accorded with the broadest interpretation so as to encompass all such modifications and similar structures.

What is claimed is:

1. An electronic lock, comprising:

a base having an opening;

an electromagnetic mechanism disposed within the base, wherein the electromagnetic mechanism has a protrusion block configured to penetrate through the opening of the base and expose outside the base;

a clamping mechanism comprising two stopping blocks;

a connecting mechanism comprising an engaging part with two connecting holes corresponding to the two stopping blocks;

a rear cover configured to fix an electronic device, the connecting mechanism arranged between the rear cover and the clamping system, wherein the rear cover has two mounting holes corresponding to the two stopping blocks, and the two stopping blocks are configured to insert into the corresponding connecting holes and the corresponding mounting holes to fix the engaging part on the rear cover; and a magnetically-attractable plate connected with the clamping mechanism and arranged between the clamping mechanism and the electromagnetic mechanism, wherein when no electric current flows through the electromagnetic mechanism, the magnetically-attractable plate is separated from the electromagnetic mechanism, wherein when the electric current flows through the electromagnetic mechanism, the magnetically-attractable plate connected with the clamping mechanism is magnetically attracted by to the electromagnetic mechanism, and when the protrusion block of the electromagnetic mechanism is pushed inwardly along a direction, the magnetically-attractable plate connected with the clamping mechanism and magnetically attracted to the electromagnetic mechanism is correspondingly moved along the direction, so that the two stopping blocks of the clamping mechanism are capable of disengaging from the corresponding connecting holes and the corresponding mounting holes.

2. The electronic lock according to claim 1, wherein the engaging part of the connecting mechanism further comprises a recess, wherein the clamping mechanism and the magnetically-attractable plate are accommodated within the recess.

3. The electronic lock according to claim 1, wherein the two stopping blocks have corresponding slant surfaces that assist in disengaging the two stopping blocks from the corresponding connecting holes and the corresponding mounting holes.

4. The electronic lock according to claim 3, wherein the clamping mechanism further comprises two elastic elements, and the two elastic elements are in contact with the corresponding stopping blocks, wherein while the clamping mechanism is moved, the two elastic elements are compressed by the corresponding stopping blocks, so that the two stopping blocks are disengaged from the corresponding connecting holes.

5. The electronic lock according to claim 1, wherein the electromagnetic mechanism comprises a pushing plate and an electromagnet, wherein the electromagnet is fixed on the pushing plate, and the protrusion block is located at a side of the pushing plate.

6. The electronic lock according to claim 1, wherein the magnetically-attractable plate is fixed on the clamping mechanism.

7. The electronic lock according to claim 1, wherein the rear cover has an accommodation space, and the engaging part is accommodated within the accommodation space.

* * * * *